US006012234A

United States Patent [19]

Schiel

[11] Patent Number: 6,012,234

[45] Date of Patent: Jan. 11, 2000

[54] DEVICE FOR DRYING A CONTINUOUS WEB

[75] Inventor: Christian Schiel, Murnau, Germany

[73] Assignee: Voith Sulzer Papiermaschinen GmbH, Heidenheim, Germany

[21] Appl. No.: 08/996,911

[22] Filed: Dec. 23, 1997

[30] Foreign Application Priority Data

Dec. 24, 1996 [DE] Germany ..... 196 54 345

[51] Int. Cl.[7] ..... F26B 11/06; D21F 5/00

[52] U.S. Cl. ..... 34/119; 34/125

[58] Field of Search ..... 34/117, 119, 124, 34/125; 162/206, 207, 209, 358

[56] References Cited

U.S. PATENT DOCUMENTS

| | | | |
|---|---|---|---|
| 3,553,849 | 1/1971 | Charrier et al. . | |
| 3,659,349 | 5/1972 | Nykopp | 34/124 |
| 3,914,875 | 10/1975 | Schiel | 34/124 X |
| 4,100,683 | 7/1978 | Barp et al. | 34/124 |
| 4,232,455 | 11/1980 | Burton . | |
| 4,663,864 | 5/1987 | Schiel . | |
| 4,781,795 | 11/1988 | Miller | 34/124 X |
| 4,880,501 | 11/1989 | Schiel | 162/358 |
| 4,978,428 | 12/1990 | Cronin et al. | 162/358 |

FOREIGN PATENT DOCUMENTS

| | | |
|---|---|---|
| 2338922 | 2/1975 | Germany . |
| 3333734 | 2/1984 | Germany . |
| 3412029 | 10/1985 | Germany . |
| 3727563 | 2/1989 | Germany . |
| 4125470 | 11/1992 | Germany . |
| 4411621 | 10/1995 | Germany . |
| 1482257 | 8/1977 | United Kingdom . |
| 2011025 | 7/1979 | United Kingdom . |
| 2173583 | 10/1986 | United Kingdom . |

OTHER PUBLICATIONS

Copy of a European Search Report dated Apr. 24, 1998 and Annex.

German Office Action dated Aug. 7, 1997, issued in connection with German Patent Application No. 196 54 345.2.

*Primary Examiner*—Henry Bennett
*Assistant Examiner*—Steve Gravini
*Attorney, Agent, or Firm*—Greenblum & Bernstein, P.L.C.

[57] ABSTRACT

A machine for drying a continuous web is provided. At least one drying cylinder around which the web is dried is provided. The cylinder includes a sleeve which transfers heat from steam in the cylinder to an outer surface which contacts the web. The sleeve includes, on an inner periphery thereof, circumferential grooves separated from each another by ribs. At least one of the grooves has a width at its radial outer end which is wider than a width at its mouth at a radial inner end. At least one of the ribs has a width at its radial outer end which is smaller a width at its radial inner end.

32 Claims, 5 Drawing Sheets

DEVICE FOR DRYING A CONTINUOUS WEB

CROSS-REFERENCE TO RELATED APPLICATIONS

The present application claims priority under 35 U.S.C. § 119 to German Patent Application No. 196 54 345.2, filed Dec. 24, 1996.

BACKGROUND OF THE INVENTION

1. Field of the Invention

The invention relates to a device for drying a continuous web. More particularly, the present invention relates to a device for drying paper, in particular hygienic papers, in which the web dries under heat and pressure applied by a drying cylinder.

2. Background and Material Information

Devices which dry a continuous web are known. In these prior art devices, at least one drying cylinder guides the web. A steady supply of steam to the core of the drying cylinder heats the periphery (sleeve) of the cylinder. When the web is guided by a press roll/section over the rotating drying cylinder, the heat from the cylinder dries the web.

For cost-effectiveness, it is crucial that as much heat as possible transmits from the cylinder core through the sleeve to optimize the use of heat from the hot steam. To improve heat transmission, the inner surface of the drying cylinder has a series of circumferential grooves which are separated from one another by ribs. The decrease in wall thickness of the sleeve at the grooves improves the overall transmission of heat from the interior of the cylinder to its outer surface, and thus to the moving web.

As the steam cools inside the drying cylinder, condensation collects on the inner surface of the grooves, and is removed in a suitable manner. However, a layer of condensation usually remains on the inner surface from which the ribs project to further conduct heat from the cylinder to the outer surface.

In these prior art devices, at least one contact-press roll contacts the drying cylinder under a predetermined pressure, the web is fed between the drying cylinder and such a contact-press roll. The applied pressure is preferably high to improve the drying process and to optimize the cost-effectiveness of the web manufacturing machine. However, the presence of the grooves weakens the flextional strength of the drying cylinder such that it cannot withstand the application of such high pressure from the contact-press roll, particularly when the contact pressure has a line force of greater than 90 kN/m.

Although an increase in sleeve thickness of the drying cylinder provides greater strength, the corresponding loss in heat transfer through the thicker sleeve offsets any such beneficial results. To date, to meet production levels of 2000 m/min, the only acceptable solution is to use extremely large drying cylinders, on the order of 5.5 m in diameter. Drying cylinders of this size are expensive and difficult to transport.

SUMMARY OF THE PRESENT INVENTION

The present invention provides a drying apparatus which overcomes the above drawbacks of the above-noted prior art.

More particularly, the present invention provides a drying cylinder having grooves which provide a higher heat transmission as the prior art, yet is much stronger to withstand high pressure supplied during web production drying.

According to an embodiment of the present invention, a machine for drying a continuous web is provided. At least one drying cylinder around which the web is dried is provided. The cylinder includes a sleeve which transfers heat from steam in the cylinder to an outer surface which contacts the web. The sleeve includes, on an inner periphery thereof, a plurality of circumferential grooves separated from each other by a plurality of ribs. At least one circumferential groove of the plurality of circumferential grooves has a width at its radial outer end which is wider than a width at its mouth at a radial inner end. At least one rib of the plurality of ribs has a width at its radial outer end which is smaller than a width at its radial inner end.

According to a feature of the above embodiment, the at least one circumferential groove has first and second walls. At least a portion of the first and second walls are positioned at an angle to a radius of the cylinder such that the at least one circumferential groove widens outward along the radial direction.

According to another feature of the above embodiment, the angle is between approximately 5° to 90° from the radius of the cylinder, preferably between approximately 7.5° to 20° from the radius of the cylinder, and particularly between approximately 10° to 15° from the radius of the cylinder.

According to a further feature of the above embodiment, the first and second walls are arranged substantially parallel adjacent the inner radial end of the at least one circumferential groove.

According to a still further feature of the above embodiment the first and second walls are arranged substantially parallel adjacent the outer radial end of the at least one circumferential groove.

According to a yet further feature of the above embodiment, the at least one rib has first and second walls. At least a portion of the first and second walls are positioned at an angle to a radius of the cylinder such that the at least one rib narrows outward along the radial direction.

According to a yet still further feature of the above embodiment, the angle is between approximately 5° to 90° from the radius of the cylinder, preferably between approximately 7.5° to 20° from the radius of the cylinder, and particularly between approximately 10° to 15° from the radius of the cylinder.

According to another feature of the above embodiment, the first and second walls are arranged substantially parallel adjacent the inner radial end of the at least one rib.

According to yet another feature of the above embodiment, the first and second walls are arranged substantially parallel adjacent the outer radial end of the at least one rib.

According to still another feature of the above embodiment, agitators are mounted adjacent the radial outer end of the at least one circumferential groove to mix condensation collected in the at least one circumferential groove.

According to yet still another feature of the above embodiment, at least three collection tubes are distributed in each of the at least one circumferential groove to suction off condensation collected in the at least one circumferential groove.

According to yet another feature of the above embodiment, dams are mounted adjacent the radial outer end of the at least one circumferential groove, under the collection tubes, which create a substantially uniform condensation layer of approximately 1 to 3 mm about the at least one circumferential groove.

According to another embodiment of the invention, a device for drying a web includes a pressure roller adjacent to, and applying pressure against, a drying cylinder. The web is fed between the pressure roller and the drying cylinder. Steam is supplied to an inner space within the drying cylinder. A sleeve forms an outer surface of the drying cylinder, and has a plurality of circumferential ribs on an inner periphery of the sleeve such that walls of the ribs define a plurality of circumferential grooves. The walls which define at least one of the circumferential grooves are further apart at a radial outermost point of the at least one of the circumferential grooves than at a radial inner point of the at least one of the circumferential grooves.

According to a feature of the above embodiment, at least a portion of the walls which define the at least one of the circumferential grooves are at an angle to a radius of the drying cylinder such that at least a portion of the at least one of the circumferential grooves widens from its inner radial end to its outer radial end.

According to a further feature of the above embodiment, the angle is between approximately 5° to 90° from the radius of the cylinder, preferably between approximately 7.5° to 20° from the radius of the cylinder, and particularly between approximately 10° to 15° from the radius of the cylinder.

According to yet a further feature of the above embodiment, the walls defining the at least one of the circumferential grooves are arranged substantially parallel adjacent the inner radial end of the at least one of the circumferential grooves.

According to a still further feature of the above embodiment, the walls defining the at least one of the circumferential grooves are arranged substantially parallel adjacent the outer radial end of the at least one of the circumferential grooves.

According to a yet still further feature of the above embodiment, the walls defining the at least one of the circumferential grooves are arranged substantially parallel adjacent the inner radial end of the at least one of the circumferential grooves, substantially parallel adjacent the outer radial end of the at least one of the circumferential grooves, and tapered away from each other therebetween along a radial outward direction.

According to another feature of the above embodiment, at least one agitator is positioned in the at least one of the circumferential grooves which, when the drying cylinder rotates, turbulizes condensation formed in the at least one of the circumferential grooves.

According to yet, another feature of the above embodiment, a condensation removal device is provided which removes condensation which collects in the at least one of the circumferential grooves.

According to still another feature of the above embodiment, the at least one agitator has a base aligned with the outer radial end of the at least one of the circumferential grooves.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the preferred embodiments of the present invention only and are presented in the cause of providing what is believe to be the most useful and readily understood description of the principles and conceptual aspects of the invention. In this regard, no attempt is made to shown structural details of the invention in more detail than necessary for the fundamental understanding of the invention, the description taken with the drawings making apparent to those skilled in the art how the several forms of the invention may be embodiment in practice.

Figure 1:
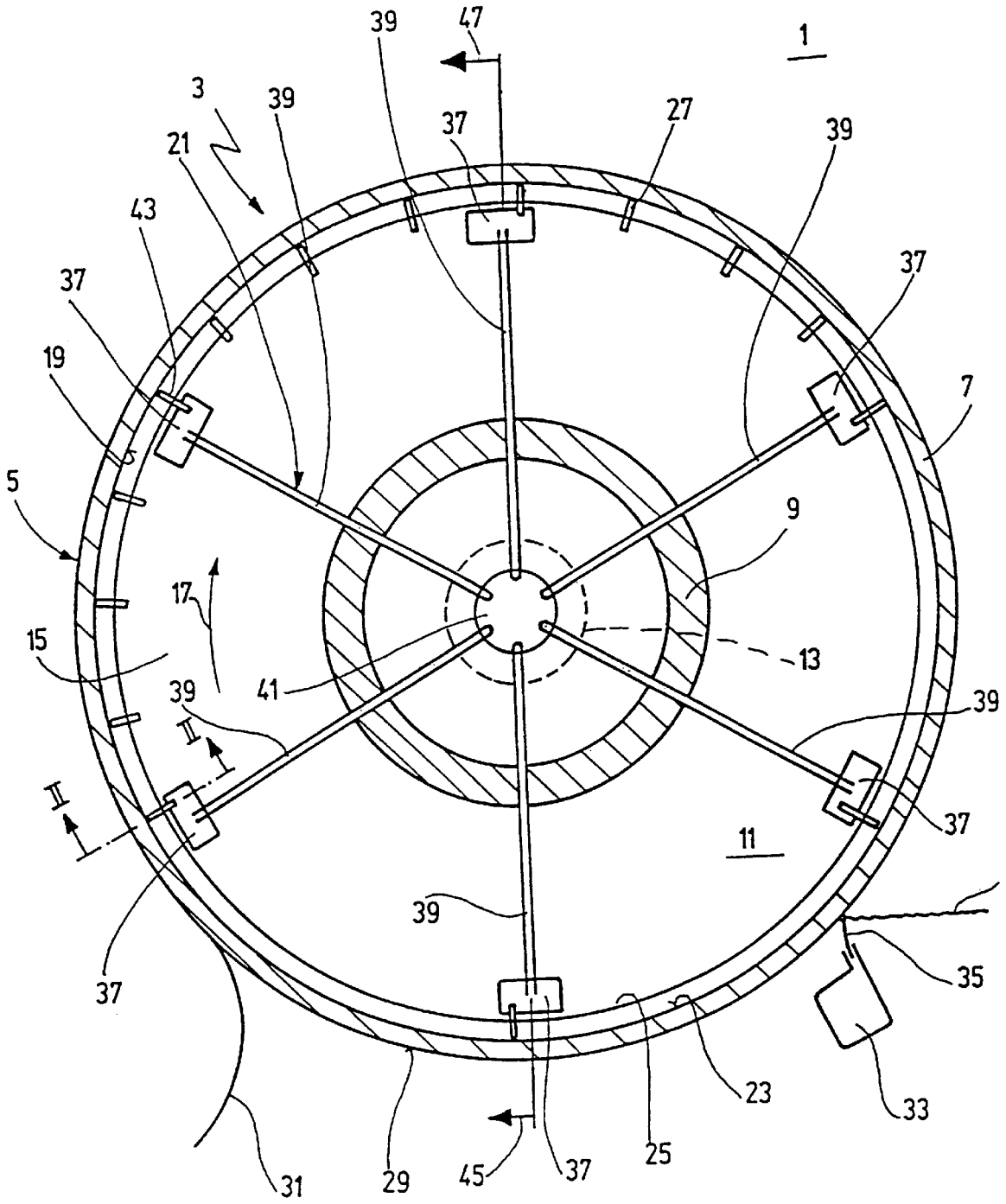
FIG. 1 is a cross-section of a drying cylinder according to the present invention, taken along the longitudinal axis.

Referring to FIG. 1, a machine 1 for manufacturing a web includes a drying section 3 with a drying cylinder 5. Drying cylinder 5 has a cylinder sleeve 7 and a hollow shaft 9, which connect to one another by a cover 11 at the longitudinal ends. Shaft 9 extends to form a bearing neck 13 (shown with a dashed line) which is secured in a suitable manner by a bearing in a case. The bearing neck is hollow to permit steam, which heats drying cylinder 5, to disperse into an inner space 15 between shaft 9 and sleeve 7. Heat from the steam transmits through sleeve 7, forming condensation when drying cylinder 5 rotates (clockwise in FIG. 1, a shown by arrow 17), and collecting on inner surface 19 of sleeve 7. A condensation removal device 21, described in greater detail below, removes most of the collected condensation.

Figure 2A:
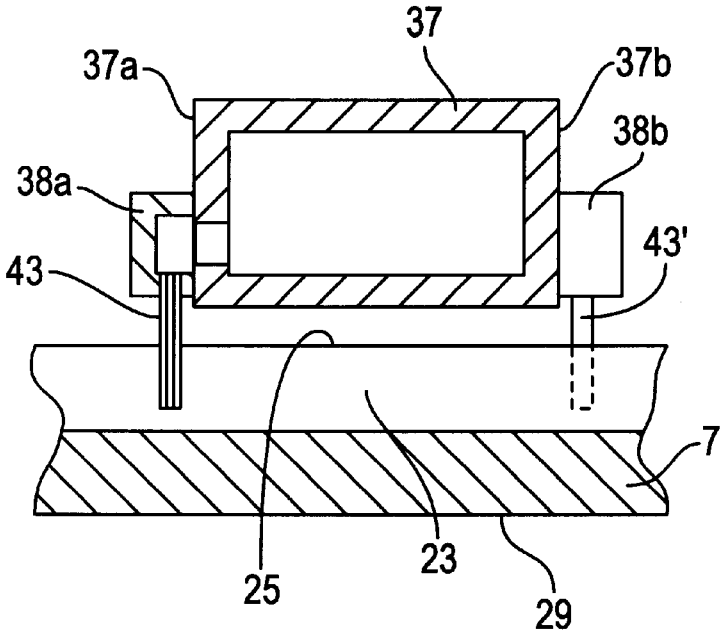
FIG. 2*a* is a cross-section of a transverse collector.
Figure 2:
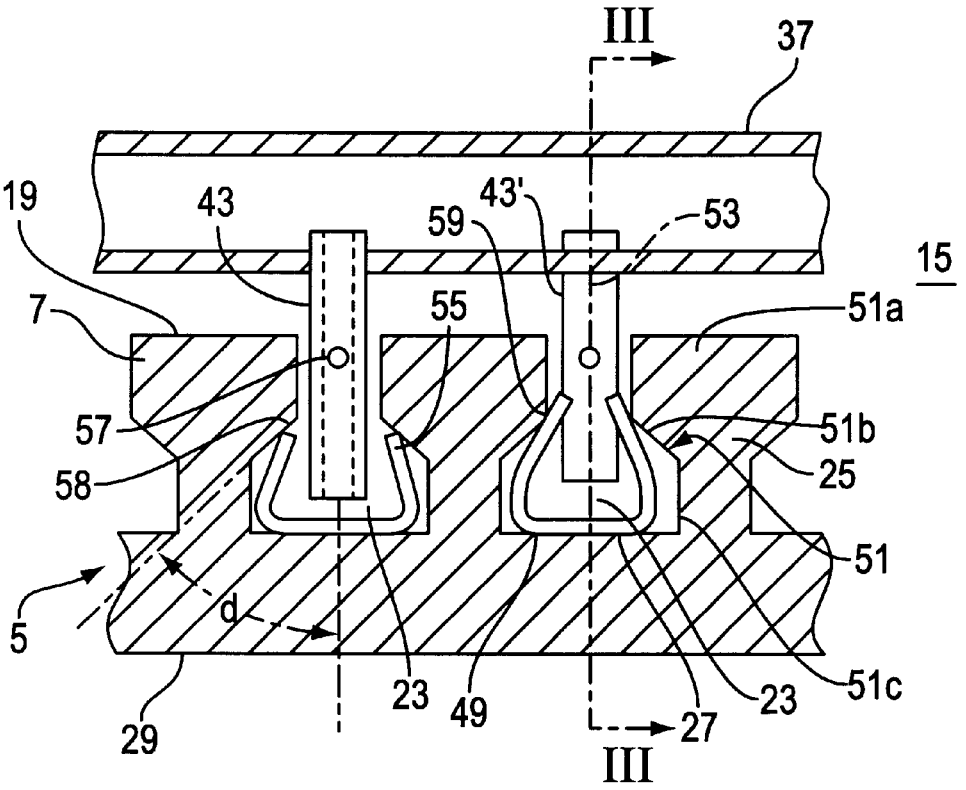
FIG. 2 is a cross-section of the sleeve of the drying cylinder taken along line II—II in FIG. 1.

Referring now also to FIG. 2, inner surface 19 of cylinder sleeve 7 includes circumferential grooves 23 which ribs 25 define. Agitators 27, positioned about grooves 23, mix condensation as it collects in grooves 23.

Figure 5:
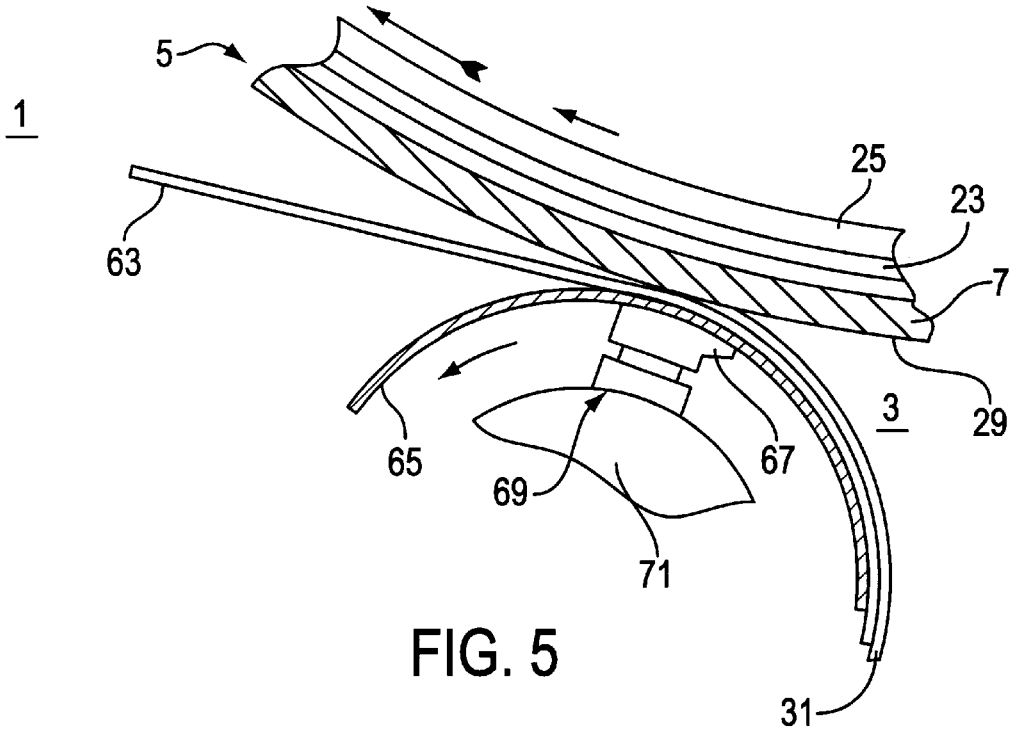
FIG. 5 is a cross-section of grooves of the interaction between the drying cylinder, the web, and a contact-press roll.

Referring now to FIG. 5, the web 31 to be dried is guided between the outer circumferential surface 29 of drying cylinder 5 and a contact-press sleeve 65. The web 31 (e.g., the hygienic paper or the crepe paper) moves with the rotation of drying cylinder 5, and is heated and dried from the heat of the steam transmitted through cylinder sleeve 7.

The dried web is removed in a suitable manner from the circumferential surface 29 of the drying cylinder 5. For example, as shown in FIG. 1, a scraper 33 having a blade 35 which extends along the width of web 31 "peels" the dried material from circumferential surface 29.

Figure 3:
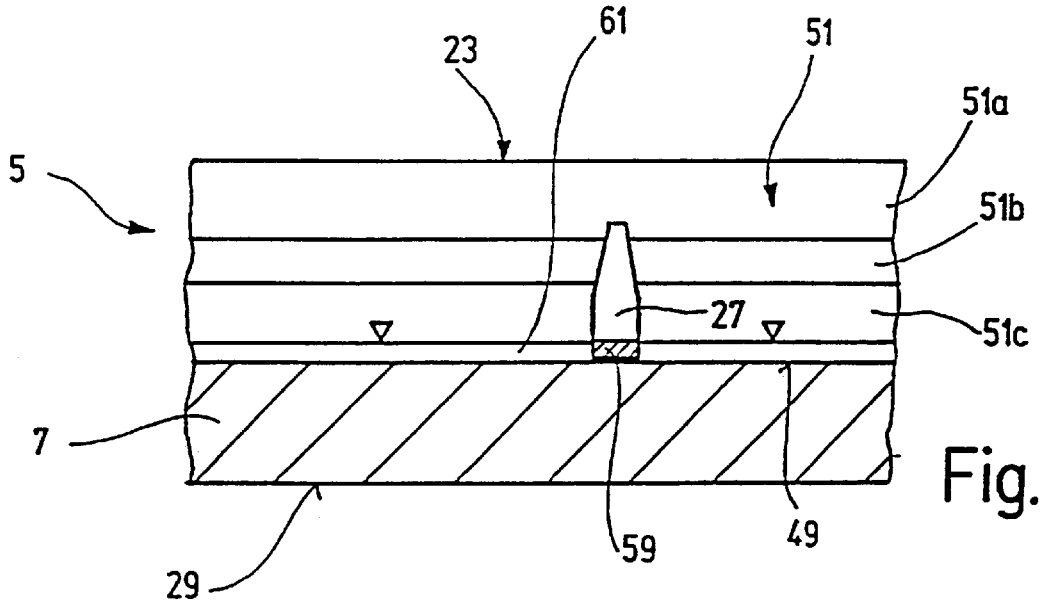
FIG. 3 is a cross-section of the drying cylinder along line III—III in FIG. 2.

Returning to FIG. 1, condensation removal device 21 includes several collectors 37, which extend along the length of the drying cylinder 5. Collectors 37 connect via ascending tubes 39 to a central condensation run off line 41, which in turn connects via the bearing necks 13 with an external condensation collection device (not shown). Each collector 37 has collection tubes 43 extending into circumferential grooves 23. The number of collectors 37 and collection tubes 43 can be freely selected, although it is has been shown that at least three collectors 37, preferably six, are necessary to achieve a relatively even thickness of a condensation film 61 (FIG. 3). In addition, orienting collection tubes 43 of adjacent grooves on opposite sides of the condensation removal device 21 improves the evenness of heat transmission.

In the embodiment shown in FIG. 1, six collection tubes 43 extending from six collectors 37 are substantially equidistant from each other. Pressure from the steam entering inner space 15 forces condensation through collector tubes 43, collectors 37, ascending tube 39, and finally to run off line 41. In addition, condensation run off line 41 can connect with another vacuum source to suction off the condensation.

Due to gravity, rotation of drying cylinder 5 causes a current in the condensation film which collects in circumferential grooves 23. Arrow 45 indicates that the condensation on the lowest nadir of the drying cylinder 5 flows in the direction of the turning motion. On the opposite, uppermost point of the drying cylinder 5, current flows opposite the direction of rotation, as indicated by arrow 47. The relative velocity in reference to the inner surface 19 in the center between the high and the low point is approximately zero.

Referring now to FIG. 2, for ease of discussion, the radius of cylinder 5 is assumed to be infinity, such that the cross-section of grooves 23 is shown as substantially horizontal. Groove 23 widens from the inner surface 19 to the outer circumferential surface 29, i.e., the width of the groove 23 is larger at its bottom (i.e., the surface of groove 23 furthest from the center of cylinder 5) than at the point at which it opens at the inner surface 19.

Walls 51 of grooves 23, which are also the walls of ribs 25, have three different sections. The first is an upper area 51*a* in which the walls are parallel to each another and an imaginary center line 53. In a transition area 51*b*, the walls angle outward at an angle $\alpha$ between 5° to 90°. In FIG. 2, the angle is approximately 45°, although an angle $\alpha$ of approximately 7.5° to 20°, in particular of approximately 10° to 15°, is preferred. An angle $\alpha$=90° produces a T-shaped groove 23.

The lowest area 51*c* of defining walls 51 again run parallel to each other and to center line 53.

The width of the circumferential groove 23 at its opening in the inner surface 19 must be large enough to accommodate the insertion of collection tube 43 from its associated transversal collector 37. Collection tube 43 extends virtually to a base 49 of groove 23. A dam 55, provided beneath the collection tube 43, dams condensation collected in circumferential groove 23 to form an even layer of condensation approximately 1 mm to 3 mm thick; this thickness eases the condensation removal process. In the present embodiment, dam 55 is essentially an U-shaped spring element which, due to its spring function, "crouches" in the transition area 51*b*. The length of the arms of dam 55 is selected such that dam 55 does not hinder the introduction of the collection tube 43. The base of dam 55 is about the same width as base 49 of the circumferential groove 23.

Each collection tube 43 has a lateral opening 57 above the expected condensation line. Preferably, the diameter of opening 57 is between approximately 30% to 50% of the diameter of the collection tube 43. This accelerates the flow of condensation into the collection tube 43. The condensation is easily removed in the running area of collection tubes 43, evenly distributing the heat on the outer surface of drying cylinder 5.

To promote a uniform temperature, the collection tubes 43 are arranged along the rotational direction in cylinder sleeve 7, as shown in FIG. 1.

As seen in FIG. 2, agitators 27, dispersed along groove 23, are similar to dams 55. However, since agitators 27 do not need to permit insertion of a collection tube 43, the arms of agitators 27 may be longer than those of dam 55. The sides of the agitator 27 project into upper area 51*a* of defining walls 51, and are supported on an edge 58 at the transition between areas 51*a* and 51*b*.

The transverse collectors 37 and collector tubes 43 are arranged in a staggered manner in the circumferential direction for selected grooves 23. However, the arrangement for each such selected groove 23 need not be identical. Thus, by way of example in FIG. 2, collection tube 43' is radially offset from collection tube 43 in a different groove 23.

In the embodiment of FIG. 2, the collection tubes 43 and 43' are guided through the wall of the transversal collector facing the inner surface 19, and secured thereon. In the alternative, referring to FIG. 2*a*, collection tubes 43 and 43' can connect with transversal collector 37 via deflection heads 38*a* and 38*b*. Deflection heads 38*a* and 38*b* extend along the width of drying cylinder 5, and connect with collection tubes 43 and 43'.

The three areas 51*a*, 51*b* and 51*c* of the defining wall of the circumferential groove 23 are shown in the cross-section of FIG. 3. A base 59 of agitator 27 rests against base 49 of groove 23. The thickness of base 59 is greater than the expected level of condensation film 61 (indicated by a line and triangles). In this embodiment, agitator 27 is a quasi-springing clasp whose vertically ascending sides are tapered upward. Using an appropriate tool, agitator 27 is inserted with its base 59 parallel with the circumferential direction of groove. The width of the base 59 is selected such that it can be inserted between adjacent upper areas 51*a* which define circumferential groove 23. Agitator 27 is then rotated by approximately 90° to the position shown in FIG. 3. The upper arms of agitator 27 wedge against defining walls 51 of groove 23, holding the agitator in place.

When drying cylinder 5 rotates, agitators 27 rotate with cylinder sleeve 7. Base 59 of agitator 27 plows through the condensation film 61 due to the relative velocity of the film versus base 49 of groove 23. The condensation is therefore at least partially mixed to ensure that the heat of the hot steam present in the inner space 15 can be transferred to the base 49 and cylinder sleeve 7. Thus, the transfer of heat from inner space 15 to circumferential surface 29 is improved by agitators 27.

The shape and size of agitators 27 is not limited to those shown in the figures. Provided that they remain in the circumferential grooves 23 when drying cylinder 5 rotates to mix the condensation, they may be designed by those skilled in the art as needed.

Figure 4:
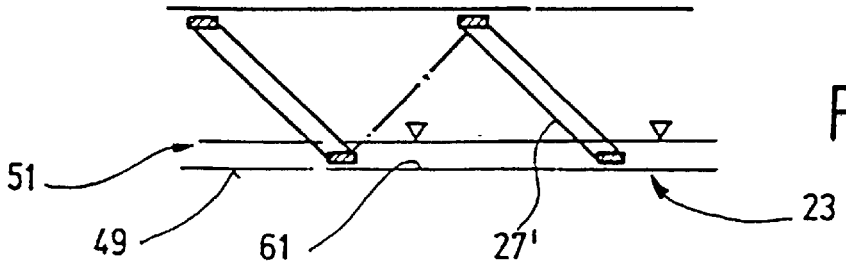
FIG. 4 is a cross-section of a groove of the drying cylinder with an agitator.

Another example of an agitator 27' is shown in FIG. 4. For ease of explanation, only lower area 51*c* is shown. Agitator 27' is a coil spring whose basic shape is an imaginary helical line and exhibits an exemplary rectangular cross section. The helical spring is designed here with four sides. It needs no special fastening, because during operation it aligns with base 49 of groove 23 due to centrifugal force. Since (1) groove 23 tapers upward, and (2) the coil spring has a width corresponding to the width of base 49 (and thus is larger than the width of groove 23 at its opening in inner surface 19), agitator 27' cannot fall out of groove 23. In this embodiment, condensation film 61 (indicated by triangles) is higher than the thickness of agitator 27'.

FIG. 5 shows part of the machine for manufacturing web 31, including drying section 3, in which the still-moist web 31 is guided onto the drying cylinder 5. A transport belt (preferably of felt) guides web 31 over a rotating press sleeve 65 to drying cylinder 5. Press sleeve 65 rotates in the opposite sense of rotation from drying cylinder 5, here clockwise. A stationary contact-press shoe 67 on a stationary carrier 71 supported by a suitable piston-cylinder arrangement 69 presses web 31 against the outer surface 29 of drying cylinder 5 in a known manner.

Circumferential surface 29 and the transport belt 63 define a press opening through which web 31 is guided. Transport belt 63 separates from circumferential surface 29 and continues tangentially thereto. Web 31 sticks to the circumferential surface 29 due to the drying process, and thus rotates with drying cylinder 5 until removed.

Contact-press shoe 67 applies very high pressure to the circumferential surface 29. However, with the structure described herein, cylinder sleeve 7 can withstand these forces. This relates to the special construction of cylinder sleeve 7, namely with the circumferential ribs 25 widening inward in the radial direction, to form a quasi hammerhead design. The T-shaped profile allows ribs 25 to absorb the considerable forces applied by contact-press shoe 67 without over-stressing the drying cylinder 5. Base 49 of groove 23 is wide enough to permit maximum heat transfer through sleeve 7, provided the condensation film 61 is agitated as described above. The hot steam introduced into the inner space 15 releases its heat into the agitated condensation film 61, and this conducts the heat with minimum resistance to the circumferential surface 29. The portion of ribs 25 which separate condensation film 61 in grooves 23 can also transfer and conduct heat to the circumferential surface 29.

The device 1 can thus be operated at a high circumferential velocity above 2,000 m/min. The diameter of drying cylinder 5, which is 5.5 m in prior art drying cylinders, can be substantially decreased. For example, while the dimensions may substantially correspond with that of the prior art, the drying cylinder of the present invention may be constructed to be smaller, i.e., to exhibit a diameter of, e.g., between approximately 3.5 m and 5 m. However, in case, that increased production capacity is desired the drying cylinder 5 may also be made as large as in prior art. In addition, the higher pressure supplied by contact-press shoe 67 and press sleeve 65 squeeze even more moisture from the web 31 (which is then absorbed by the absorbent transport belt 63 and latter removed).

Figure 6:
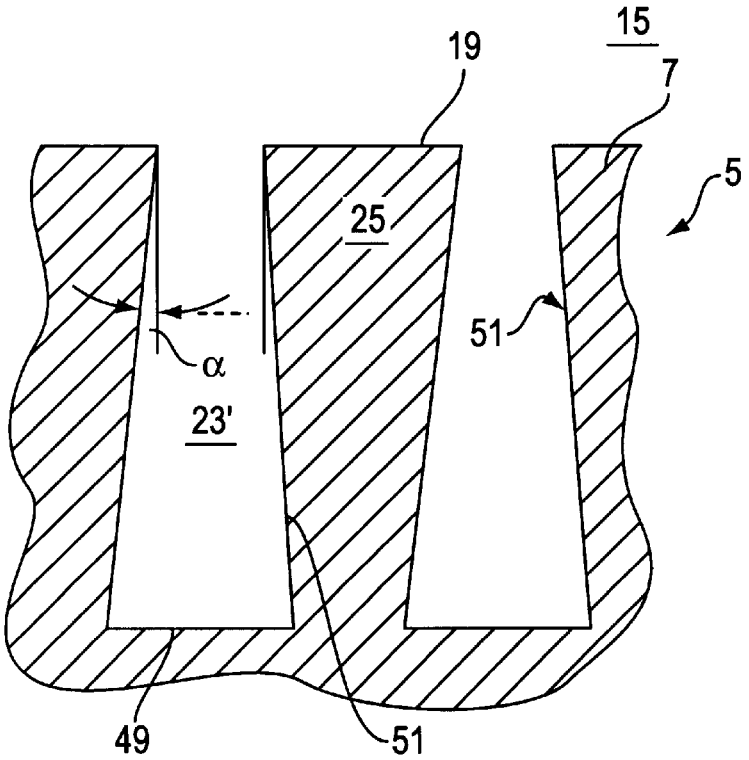
FIG. 6 is a cross section of another embodiment of a groove of the drying apparatus.

FIG. 6 shows another embodiment of cylinder sleeve 7. In this embodiment, defining walls 51 of grooves 23' are quasi conical, i.e., they open radially outward by an angle of approximately $\alpha=5°$. A distance between defining walls 51 thus gradually increases along the entire radial portion of its length.

As seen in FIG. 6, base 49 of groove 23' is wider than the mouth opening in the inner surface 19. Similarly, a rib 25 tapers outward in the radial direction to define two adjacent grooves 23'. Each rib 25 thus has wide head facing inner space 15 and a relatively narrow bottom adjacent base 49.

Figure 7:
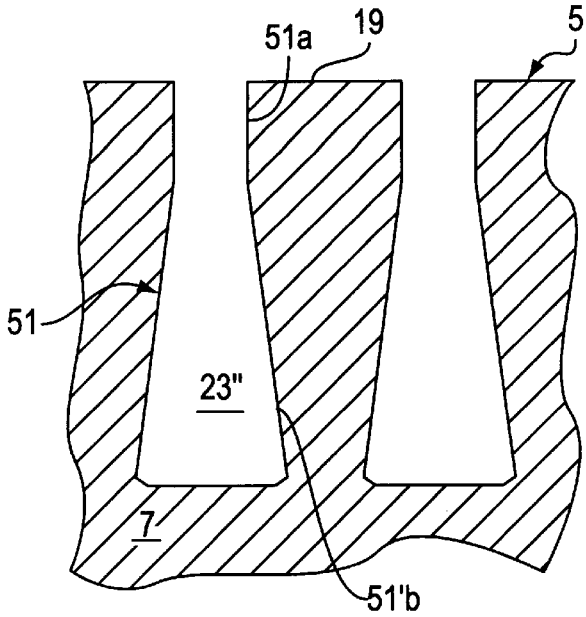
FIG. 7 is a cross section of yet another embodiment of a groove of the drying apparatus.

A similar embodiment is shown in FIG. 7. Defining walls 51 define groove 23", including parallel upper areas 51*a*, and a conical area 51'*b*. The parallel lower areas 51*c* of defining walls 51 in the embodiment shown in FIG. 2 is absent from this embodiment.

Figure 8:
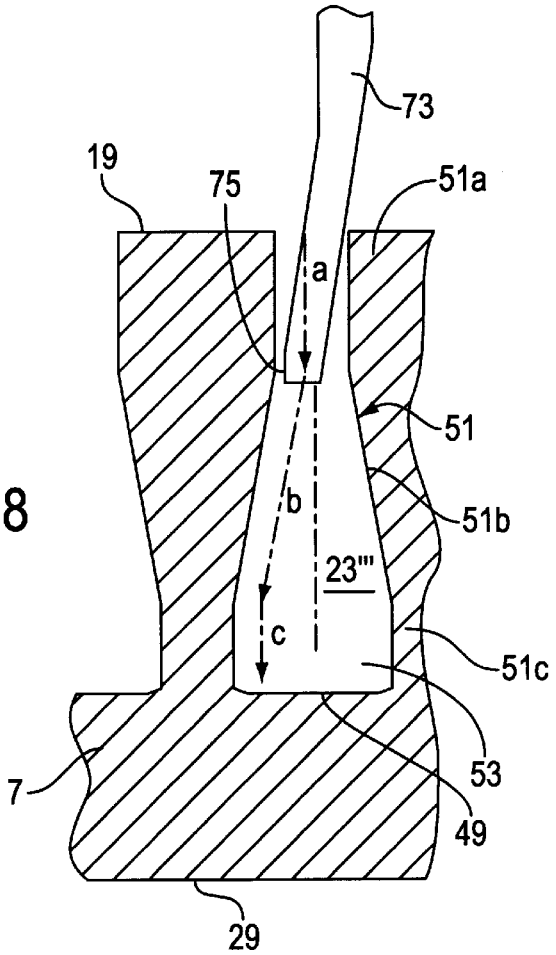
FIG. 8 is a cross section of a groove with a tool which shapes the groove.

Another embodiment, and a tool for shaping the embodiment, are shown in FIG. 8. A groove 23" has defining walls 51 with the orientation as discussed in FIG. 2, i.e., parallel upper areas 51*a*, outwardly tapering middle areas 51*b*, and parallel lower areas 51*c* which form into base 49. A tool 73 has a bezel 75 for shaping the defining walls 51. As indicated by the dashed line, tool 73 first moves downward (radially outward) along path a (center line 53), then laterally along path b, and finally downward again along path c, to produce areas 51*a–c*.

Although the above description of tool 73 is directed to groove 23"', any of grooves 23-23" described herein can be shaped in a similar manner.

In addition, as shown in FIGS. 7 and 8, each of grooves 23-23"' may have a rounded transition area between lower area 51*c* and base 49 which distributes applied pressure along the surface of sleeve 7.

Preferably, drying cylinder 5 has a uniform cross section (i.e., all grooves and ribs have the same shape) to ensure even heat transfer and uniform flextional strength. However, the present invention is not so limited. For example, the grooves of the present invention could be used in combination with conventional grooves of the prior art. Similarly, a combination of grooves 23-23"' may be used.

It has been shown that, by using the groove configuration of the present invention, the diameter and weight of a drying cylinder can be reduced. Further, since the ribs 25 are also shorter, the steam pressure needed to remove condensation is also reduced. Thus, only a relatively slight differential pressure is required to transport the condensation from drying cylinder 5.

Using the circumferential grooves and ribs described here, the present invention has a high flextional strength to withstand the application of high pressure, as well as a minimal heat-permeation resistance such that heat from the steam directly reaches a relatively large area of cylinder sleeve 7. In addition, ribs 25 can absorb and transfer heat from inner space 15 to circumferential surface 29 by the relatively narrow bridge on the radial outside of ribs 25. The decreasing width of rib 25 along the radial direction creates a high resistance to the high stresses produced from the pressure of web 31 on circumferential surface 29.

Preferably, the width of grooves 23 between ribs 25 at the outermost point occupies approximately 35% to 45% of the rib separation, while the width of ribs 25 occupies preferably approximately 55% to 65% of the separation, where "separation" is the distance from the center to the center of two adjacent circumferential grooves or ribs. In addition, the ribs must nonetheless have sufficient thickness at the radial end to provide appropriate flextional strength. Consequently, the optimal relationship of channel width and separation between the rib heads is approximately 0.25 to 0.4 of the distance from the center of adjacent grooves. Similarly, the optimal relationship of channel width and separation between the rib heads in the base area is approximately 0.45 to 0.7 of the distance from the center of adjacent grooves.

In FIGS. 2, 3 and 8, lower area 51*c* is preferably approximately 5 mm to 25 mm high, particularly approximately 12 mm.

As discussed above, agitators 27 are preferably U-shaped clasps made of sheet metal. The middle section between the sides is approximately 5 mm to 12 mm wide (as measured in the circumferential direction). The sides are either even in width or, as shown in FIG. 3, tapered to their ends to a width of approximately 2 mm to 4 mm. The sheet metal thickness is preferably approximately 1.2 to 1.4 times as thick as the condensation film 61.

The width of the agitator 27 is somewhat less than that of the widest width of the circumferential groove 23 near base 49. This simplifies the installation of agitator 27, as placing agitator 27 in groove 23 and wedging the unit by rotating it approximately 90° on its radial axis is a relatively easy step.

The heat transfer through the circumferential grooves is greater than or equal to that through the ribs. Transfer of heat substantially improves the wider the circumferential grooves are near base 49 and the narrower they are near the inner surface 19. Agitators 27 optimize heat transfer 27, and may take many forms other than those discussed herein (e.g., shovel or rake shapes), provided that the condensation is agitated in the circumferential grooves when the drying cylinder rotates.

While the invention has been described with reference to several exemplary embodiments, it is understood that the words which have been used herein are words of description and illustration, rather than words of limitations. Changes may be made, within the purview of the pending claims, as without affecting the scope and spirit of the invention and its aspects. While the invention has been described here with reference to particular means, materials and embodiments, the invention is not intended to be limited to the particular disclosed herein; rather, the invention extends to all functionally equivalent structures, methods and uses, such at all within the scope of the appended claims.

By way of non-limiting example, the above description is directed particularly to drying hygienic papers or crepe paper, which typically requires only a single drying cylinder. However, the invention is not so limited, as any number of drying cylinders may be used as appropriate for a particular web.

It is noted that the various cross sections of FIGS. 2–4 and 6–8 are substantially planar due to the assumption that the radius of drying cylinder 5 is infinite. Of course, in practice, these structures will be curved in their cross-section in accordance with the actual radius of drying cylinder 5. Similarly, references herein to orientations such as "base", "upward" or "downward" is from the perspective of the outer radial end of drying cylinder 5 being aligned with the bottom of the page in these figures.

What is claimed is:

1. A machine for drying a continuous web, comprising:

at least one drying cylinder around which the web is dried;

said cylinder including a sleeve adapted to transfer heat from steam in said cylinder to an outer surface which contacts said web;

said sleeve including, on an inner periphery thereof, a plurality of circumferential grooves separated from each other by a plurality of ribs, each said circumferential groove circumferentially extending about said inner periphery of said sleeve;

at least one circumferential groove of said plurality of circumferential grooves having a width at its radial outer end which is wider than a width at its mouth at a radial inner end; and at least one rib of said plurality of ribs having a width at its radial outer end which is smaller than a width at its radial inner end.

2. The machine of claim 1, said at least one circumferential groove having first and second walls; and at least a portion of said first and second walls being positioned at an angle to a radius of said cylinder such that said at least one circumferential groove widens outward along the radial direction.

3. The machine of claim 2, wherein said angle is between approximately 5° to 90° from said radius of said cylinder.

4. The machine of claim 2, wherein said angle is between approximately 7.5° to 20° from said radius of said cylinder.

5. The machine of claim 2, wherein said angle is between approximately 10° to 15° from said radius of said cylinder.

6. The machine of claim 2, said first and second walls are arranged substantially parallel adjacent said inner radial end of said at least one circumferential groove.

7. The machine of claim 2, said first and second walls are arranged substantially parallel adjacent said outer radial end of said at least one circumferential groove.

8. The machine of claim 1, said at least one rib having first and second walls;

at least a portion of said first and second walls being positioned at an angle to a radius of said cylinder such that said at least one rib narrows outward along the radial direction.

9. The machine of claim 8, wherein said angle is between approximately 5° to 90° from said radius of said cylinder.

10. The machine of claim 8, wherein said angle is between approximately 7.5° to 20° from said radius of said cylinder.

11. The machine of claim 8, wherein said angle is between approximately 10° to 15° from said radius of said cylinder.

12. The machine of claim 8, said first and second walls are arranged substantially parallel adjacent said inner radial end of said at least one rib.

13. The machine of claim 8, said first and second walls are arranged substantially parallel adjacent said outer radial end of said at least one rib.

14. The machine of claim 1, further comprising agitators mounted adjacent said radial outer end of said at least one circumferential groove which mix condensation collected in said at least one circumferential groove.

15. The machine of claim 1, further comprising at least three collection tubes distributed in each of said at least one circumferential groove to suction off condensation collected in said at least one circumferential groove.

16. The machine of claim 15, further comprising dams mounted adjacent said radial outer end of said at least one circumferential groove, under said collection tubes, which create a substantially uniform condensation layer of approximately 1 to 3 mm about said at least one circumferential groove.

17. The machine of claim 1, said at least one circumferential groove having first and second walls;

said groove having a base that is substantially perpendicular to a radius of said cylinder; and at least a portion of said first and second walls being positioned at an angle to a radius of said cylinder such that said at least one circumferential groove widens outward along the radial direction.

18. The machine of claim 1, said at least one circumferential groove having first and second walls, each respective said wall comprising:

an upper area;

a transition area; and a lower area; and said transition area being positioned at an angle to a radius of said cylinder such that said at least one circumferential groove widens outward along the radial direction.

19. The machine of claim 18, wherein said upper area is parallel to said lower area.

20. The machine of claim 1, said at least one circumferential groove having first and second walls, each respective said wall comprising:

an upper area;

a transition area; and a lower area parallel to said upper area;

said transition area being positioned at an angle to a radius of said cylinder such that said at least one circumferential groove widens outward along the radial direction; and wherein said plurality of grooves each have a base that is substantially perpendicular to a radius of said cylinder.

21. A device for drying a web including a pressure roller adjacent to, and applying pressure against, a drying cylinder, said web being fed between said pressure roller and said drying cylinder, and steam being supplied to an inner space within said drying cylinder, said drying cylinder comprising:

a sleeve forming an outer surface of said drying cylinder, and having a plurality of circumferential ribs on an inner periphery of said sleeve such that walls of said ribs define a plurality of circumferential grooves, each said circumferential groove circumferentially extending about said inner periphery of said sleeve and adapted to receive steam; and said walls which define at least one of said circumferential grooves being further apart at a radial outermost point of said at least one of said circumferential grooves than at a radial inner point of said at least one of said circumferential grooves.

22. The device of claim 1, wherein at least a portion of said walls which define said at least one of said circumferential grooves are at an angle to a radius of said drying cylinder such that at least a portion of said at least one of said circumferential grooves widens from its inner radial end to its outer radial end.

23. The device of claim 22, wherein said angle is between approximately 5° to 90° from said radius of said cylinder.

24. The device of claim 22, wherein said angle is between approximately 7.5° to 20° from said radius of said cylinder.

25. The device of claim 22, wherein said angle is between approximately 10° to 15° from said radius of said cylinder.

26. The device of claim 22, said walls defining said at least one of said circumferential grooves are arranged substantially parallel adjacent said inner radial end of said at least one of said circumferential grooves.

27. The device of claim 22, said walls defining said at least one of said circumferential grooves are arranged substantially parallel adjacent said outer radial end of said at least one of said circumferential grooves.

28. The device of claim 22, said walls defining said at least one of said circumferential grooves are arranged substantially parallel adjacent said inner radial end of said at least one of said circumferential grooves, substantially parallel adjacent said outer radial end of said at least one of said circumferential grooves, and tapered away from each other therebetween along a outward radial direction.

29. The device of claim 21, further comprising at least one agitator positioned in said at least one of said circumferential grooves which, when said drying cylinder rotates, collects condensation formed in said at least one of said circumferential grooves.

30. The device of claim 21, further comprising a condensation removal device which removes condensation which collects in said at least one of said circumferential grooves.

31. The device of claim 29, wherein said at least one agitator has a base aligned with said outer radial end of said at least one of said circumferential grooves.

32. The device of claim 21, wherein said plurality of grooves each have a base that is substantially perpendicular to a radius of said cylinder.

* * * * *